United States Patent [19]

Herrera-Cabello

[11] 4,219,594

[45] Aug. 26, 1980

[54] MAGNETIC ARTIFICIAL TREE ORNAMENT

[76] Inventor: Tirso R. Herrera-Cabello, 7326 W. 18 Ave., Hialeah, Fla. 33012

[21] Appl. No.: 8,377

[22] Filed: Feb. 1, 1979

Related U.S. Application Data

[63] Continuation of Ser. No. 814,313, Jul. 11, 1977, abandoned.

[51] Int. Cl.[2] ..... A47G 33/06

[52] U.S. Cl. ..... 428/18; 211/DIG. 1; 248/206 A; 248/309 R; 428/900

[58] Field of Search ..... 428/7, 17, 18, 19, 20, 428/900; D11/118; 211/DIG. 1, 196, 205; 362/123; 248/27.8, 206 A, 309 R; 156/61

[56] References Cited

U.S. PATENT DOCUMENTS

| | | | |
|---|---|---|---|
| 1,677,919 | 7/1928 | Hansen | 428/900 X |
| 2,508,925 | 5/1950 | Metz | 428/18 X |
| 2,553,103 | 5/1951 | Miller | 248/27.8 |
| 2,599,047 | 6/1952 | Clark | 428/900 X |
| 2,659,169 | 11/1953 | Brennan | 428/900 X |
| 2,760,744 | 8/1956 | Watrous | 428/900 X |
| 2,806,314 | 9/1957 | Moran | 428/11 X |
| 3,019,910 | 2/1962 | Greene | 211/87 |
| 3,035,162 | 5/1962 | Emmich | 428/11 X |
| 3,164,352 | 1/1965 | Weaver | 428/17 X |
| 3,209,729 | 10/1965 | Zedaker | 428/900 X |
| 3,694,648 | 9/1972 | Yates | 428/11 X |
| 4,011,674 | 3/1977 | Jacobson | 428/18 X |

FOREIGN PATENT DOCUMENTS

| | | | |
|---|---|---|---|
| 1126224 | 7/1956 | France | 248/206 A |

*Primary Examiner*—Henry F. Epstein
*Attorney, Agent, or Firm*—Gustave Miller

[57] ABSTRACT

This device is a tree ornament which is magnetically attachable to an artificial tree. Artificial trees usually have branch twigs either permanently attached, or attachable, by inserting the end of each through spaced apertues through the branches.

This device makes it very easy to attach or detach any ornament to the tree, by using a magnetizable or magnetic element either or both on the ornament or on the tree branch or tree branch twig. Many artificial tree branches are built about an axial ferrous core and, in such case, the ornament has a permanent magnet built into or on the ornament, and the ornament thus readily attaches to and detaches from the branch. The magnetic flux of the ornament magnet is selected to be strong enough to attach to the axial core of the branch.

Alternatively, the axial core may be made with spaced loops thereon extending to or through the branch surface.

When the twigs are attached by being inserted through previously prepared transverse apertures spaced along the branches, the twigs are provided with a stem. In this device, the stem is selected to be either of ferrous material or a magnetized stem, and the ornament has either a ferrous attaching cap or a magnetic cap to cooperate with the magnetic or ferrous cap.

1 Claim, 7 Drawing Figures

MAGNETIC ARTIFICIAL TREE ORNAMENT

This is a continuation of application Ser. No. 814,313, filed July 11, 1977, and now abandoned.

OBJECTS OF THE INVENTION

It is an object of this invention to provide a Xmas tree ornament for ready attachment and detachment to or from an artificial tree which involves a ferrous or magnetic structure in either the ornament or the twig branch or twig, or in both, with opposite magnetic poles.

A further object of this invention is to take advantage of the ferrous core often provided in artificial Xmas tree branches and provide a magnet on the ornament having sufficient magnetic flux to hold to the branch ferrous core, whether the core is axial or brought to the surface in spaced spots.

A further object of this invention is to provide an improved way of providing a magnet on a Xmas tree ornament of the hollow glass ball type having an opening provided with a magnet carrying cap thereon, the cap holding to the neck either frictionally or by a spring extended into the ball.

A yet further object of this invention is to provide a branch twig with a rigid ferrous stem for insertion through the spaced apertures present in the artificial stem, so that a magnet may be placed on the ornament for ready attachment to or detachment from the twig ferrous stem.

Yet a further object of this invention is to provide an improvement over the prior art, including U.S. Pat. Nos. 1,677,919, 2,659,169, 2,806,314, 3,019,910, 3,164,352, 2,599,047.

With the above and other related objects in view, this invention consists in the details of construction and combination of parts as will be more fully understood from the following description when read in conjunction with the accompanying drawing, in which.

DETAILED DESCRIPTION OF THE INVENTION

Figure 1:
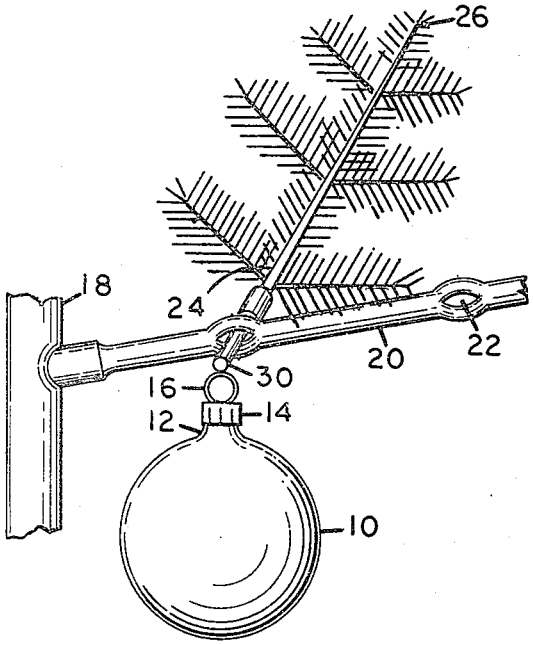
FIG. 1 is a view of one way of magnetically attaching a Xmas tree ball ornament to an artificial Xmas tree.

There is shown at 10 a conventional tree hollow glass or plastic ball or ornament for hanging on a Xmas tree branch or twig, the ball having a neck 12 with a cap 14 to which is secured a ring 16 so that the ball 10 may be pinned or clipped to a conventional natural Xmas tree through the ball ring 16. Clipping or pinning a ball ring 16 is a tedious job, often accounting for numerous pricked fingers, fumbling of the ornament with resultant dropping and possible breakage, and expletives by the operator.

Artificial Xmas trees 18 are now being often used as they are more economical because they may be disassembled for further use, rather than only one time.

In one form, the artificial tree branch 20 is provided with spaced transverse apertures 22 through which the stem 24 of an artificial twig 26 may be directly inserted to hold the twig 26 on the artificial branch 20. This, of course, is somewhat tedius and difficult in lining up and inserting the artificial plastic twig stems 24 through the apertures 22. If the aperture is large enough to insert the twig stem easily, it will not hold well, and the twig 26 easily drops off. If a tight enough fit for the stem 24 and branch aperture 22 assembling is very tedious and difficult.

In this invention, a cap 28 is secured permanently over the twig stem 24, and secured in the cap 28 is a ferrous or magnetic rigid shaft 30, this ferrous or magnetic shaft being of metal and is much easier to insert through the branch apertures than would be the artificial plastic twig stem 24. Inasmuch as the ring 16 is usually made of ferrous material, it readily attaches to and holds onto the magnetic stem 30. Obviously, a ferrous material ring 16 is always used, if not normally present. With this magnetic attachment, the ornaments 10 are attached at the beginning of the season, and as readily detached and stores away at the end of the Xmas season.

Figure 2:
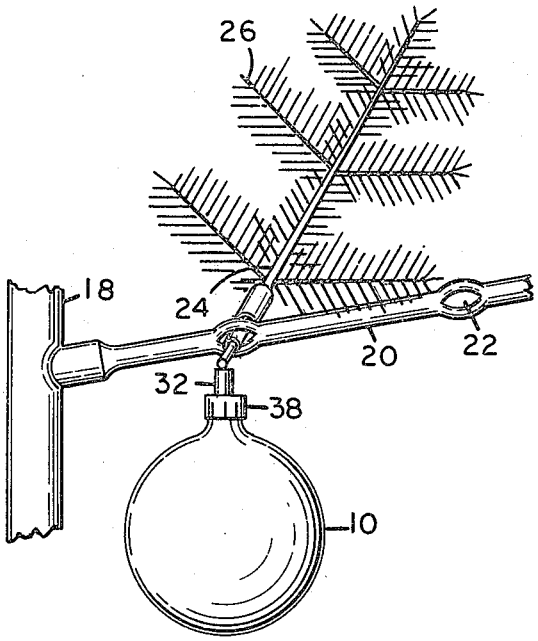
FIG. 2 shows a slightly different attachment.
Figure 3:
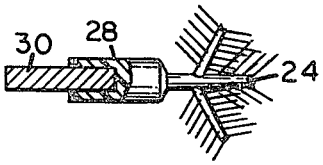
FIG. 3 is a section of a twig attaching ferrous or magnetic stem.
Figure 7:
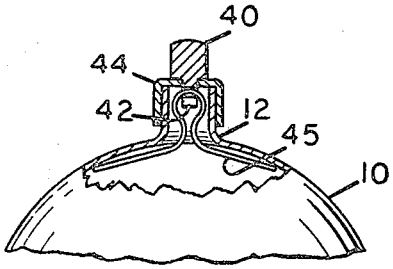
FIG. 7 is a similar view of a cap having a spring therethrough for holding it inside a ball neck.
Figure 6:
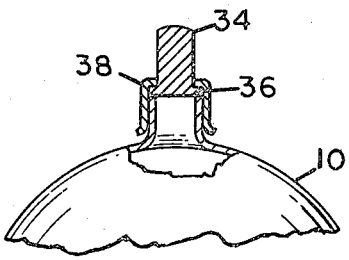
FIG. 6 shows a ball and a ferrous boss, or magnet, frictionally mounted on an ornament ball neck by means of a neck cap having a ferrous or magnetic plug extending therethrough.

In FIG. 2, a ferrous or magnetic shaft 32 is shown as being mounted on neck 12 of the ornamental ball. In FIG. 6 a magnetic or ferrous shaft 34 has an enlarged base 36, and this shaft 34 extends through a cap 38 frictionally mounted on neck 12 of ball 10. In FIG. 7, a magnetic or ferrous shaft 40 has a transversely apertured extension 42 extending through a cap 44 and is provided with an expanded spring 45 which is temporarily compressed, so that it may be inserted through neck 12 to hold the shaft 40 and cap 44 on the neck 12.

Figure 4:
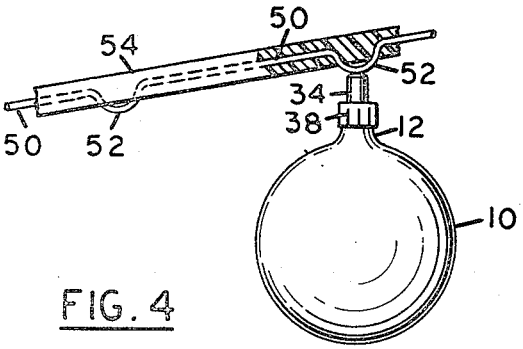
FIG. 4 shows a ball ornament magnetic attachment to an artificial tree branch looped core.
Figure 5:
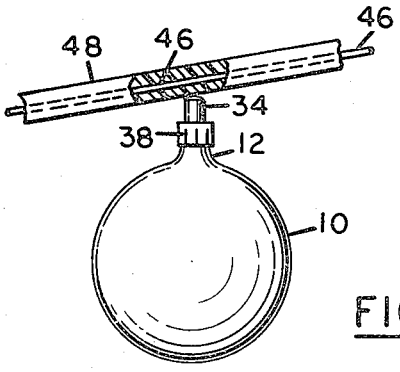
FIG. 5 shows a view similar to FIG. 4, the core remaining axially located.

In FIG. 5, a ball 10 has its magnetic stem exerting its magnetic flux on the ferrous axial core 46 of an artificial branch 48. In FIG. 4, the axial core 50 is looped at 52 to or through the surface of branch 54.

Obviously, any other conventional type of tree ornament may be used, so long as a ferrous or magnetic stem may be attached thereto for cooperating with a twig magnetic or ferrous stem 30.

In the drawing, like numbers refer to like parts, and, for the purposes of explication set forth below are the numbered parts of the MAGNETIC XMAS TREE ORNAMENT of this invention.

10 tree ornament
12 ornament ball neck
14 neck cap
16 ball ring
18 artificial tree
20 tree branch
22 transverse apertures through 20
24 twig stem
26 twig
28 cap secured on twig stem 24
30 magnetic shaft in twig cap 28
32 magnetic shaft mounted on ball neck 12 in FIG. 2
34 magnetic shaft in FIG. 6.
36 enlarged base of 34
38 cap for 34, 36
40 magnetic shaft in FIG. 7
42 transversely apertured extension of 40
44 cap for 40
45 spring retainer through 42
46 axial core of branch 48 in FIG. 5

48 artificial branch having axial core 46

50 axial core in branch 54 in FIG. 4

52 looped core in FIG. 4

54 artificial branch

Although this invention has been described in considerable detail, such description is intended as being illustrative rather than limiting, since the invention may variously be embodied, and the scope of the invention is to be determined as claimed.

Having thus set forth and disclosed the nature of this invention, what is claimed is:

1. An ornamental artificial Christmas tree comprising an artificial tree trunk, an artificial branch extending from said trunk, a simulated stem carrying artificial pine needles supported by said branch at a location spaced from said trunk, said stem having a lower portion provided with a first member of magnetic material extending through and below an opening in said branch, an ornament for said tree having a second member of magnetic material, said first and second members being in engagement, one of said members comprising a permanent magnet for readily detachably suspending said ornament from said lower portion of the stem.

* * * * *

UNITED STATES PATENT OFFICE

CERTIFICATE OF CORRECTION

Patent No. 4,219,594 Dated Aug. 26, 1980

Inventor(s) Tirso R. Herrera-Cabello

It is certified that error appears in the above-identified patent and that said Letters Patent are hereby corrected as shown below:

Col. 1, lines 8, 15, 21, 42, 60, 63, col. 2, lines 1 and 26, "Xmas" is cancelled.

Col. 2, line 47. "XMAS" is cancelled.

In the claim, line 1, "Christmas" is cancelled.

Signed and Sealed this

Ninth Day of December 1980

[SEAL]

Attest:

SIDNEY A. DIAMOND

Attesting Officer

Commissioner of Patents and Trademarks